United States Patent [19]

Haydon et al.

[11] Patent Number: 4,938,805

[45] Date of Patent: Jul. 3, 1990

[54] NOVEL COBALT-BASE SUPERALLOY AND CAST AND WELDED INDUSTRIAL GAS TURBINE COMPONENTS THEREOF AND METHOD

[75] Inventors: John S. Haydon, Mayfield; Adrian M. Beltran; John H. Wood, both of Ballston Spa, all of N.Y.

[73] Assignee: General Electric Company, Schenectady, N.Y.

[21] Appl. No.: 885,070

[22] Filed: Jul. 14, 1986

Related U.S. Application Data

[63] Continuation-in-part of Ser. No. 678,118, Dec. 9, 1984, abandoned.

[51] Int. Cl.[5] ..... C22F 1/10

[52] U.S. Cl. ..... 148/3; 148/158; 148/408; 428/668

[58] Field of Search ..... 420/436, 439, 440; 428/668; 148/408, 3, 158, 425

[56] References Cited

U.S. PATENT DOCUMENTS

| | | | |
|---|---|---|---|
| 3,118,763 | 1/1964 | Thielemann | 75/171 |
| 3,314,784 | 4/1967 | McQuillan et al. | 75/171 |
| 3,333,957 | 8/1967 | Thielemann | 75/171 |
| 3,366,478 | 1/1968 | Wheaton | 75/171 |
| 3,383,205 | 5/1968 | Sims et al. | 75/171 |
| 3,432,294 | 3/1969 | Wheaton | 75/171 |
| 3,549,356 | 12/1970 | Sims et al. | 75/171 |
| 3,582,320 | 6/1971 | Herchenroeder | 75/171 |
| 3,933,484 | 7/1976 | Costin | 75/171 |
| 4,437,913 | 3/1984 | Fukui et al. | 148/408 |

FOREIGN PATENT DOCUMENTS

| | | |
|---|---|---|
| 2074104 | 10/1971 | France . |
| 2273075 | 12/1975 | France . |
| 891550 | 3/1962 | United Kingdom . |
| 2094342 | 9/1982 | United Kingdom . |

*Primary Examiner*—R. Dear

*Attorney, Agent, or Firm*—Jerome C. Squillaro

[57] ABSTRACT

Cobalt-base superalloys having special utility in the production of industrial gas turbine hot gas path components because of their unique combination of properties in specially heat-treated condition including excellent hot corrosion resistance, stress-rupture strength at high temperature, metallurgical stability, tensile ductility and weldability, consist essentially of 0.3 to 0.6% carbon, 27–35% chromium, 9–16% nickel, 6–9% tungsten, 0.45 to 2.0% tantalum, up to 3.0% hafnium, up to 0.7% zirconium, not more than 2.0% iron, 1.5% manganese and silicon and 0.05% boron, balance cobalt, the carbide formers being selected to satisfy the following equations:

$$\frac{\text{Atomic Percent (Ta + Hf + Ti + Zr + Cb)}}{\text{Atomic Percent C}} = 0.4 \text{ to } 0.8$$

and $$\frac{\text{Atomic Percent Ta}}{\text{Atomic Percent C}} = >0.1$$

8 Claims, 5 Drawing Sheets

NOVEL COBALT-BASE SUPERALLOY AND CAST AND WELDED INDUSTRIAL GAS TURBINE COMPONENTS THEREOF AND METHOD

This is a continuation -in-part of U.S. patent application Ser. No. 678,118 filed on Dec. 9, 1984 abandoned.

FIELD OF THE INVENTION

This invention relates generally to the superalloy branch of the metallurgical art, and is more specifically concerned with new cobalt-base superalloys having an unique combination of properties and consequent special utility in the production of both cast articles and welded structures, and with novel industrial gas turbine hot gas path components of those new alloys, and with a new method of producing those novel components.

BACKGROUND

Cobalt-base superalloys disclosed and claimed in U.S. Pat. No. 3,383,205 have superior oxidation and hot corrosion resistance and as a consequence have long been used extensively in commercial production of industrial gas turbine nozzles. In fact, one of those superalloys is the current first stage nozzle alloy of General Electric Company, the assignee hereof The creep rupture and fatigue strength of that alloy, however, are marginal for new industrial gas turbine nozzle applications and in recognition of that fact, a program was launched to improve those properties without significantly diminishing the resistance of the superalloy either to oxidation or to hot corrosion. While the resulting superalloys met those objectives as a consequence of their relatively high carbon contents (0.40 to 0.50%), they were still not the answer to the problem because of their inferior weldability and low tensile ductility.

SUMMARY OF THE INVENTION

Through our discoveries and new concepts detailed below, we have created new cobalt-base superalloys and articles made thereof having a previously unobtainable combination of desirable properties. Thus we have found the way to avoid having to make the trade-offs of desirable properties exemplified by the problem mentioned above. This invention in providing the answers to that problem embodies those discoveries and new concepts of ours and they are epitomized in the appended claims directed to alloy compositions, to articles of manufacture of those compositions, and to the special treatment necessary to maximize the strength of cast bodies of these new alloy compositions without diminishing other desirable characteristics of them.

One of our concepts upon which this invention is based is that weldability and tensile ductility of cobalt-base superalloys need not be significantly compromised in order to increase creep strength very substantially. In particular, beneficial effects of increased carbon content can be obtained without the normally attending detrimental effects thereof by addition of one of more of the following strong monocarbide MC-formers: hafnium, tantalum, zirconium and titanium. Columbium, another strong monocarbide MC-carbide former, is not a preferred addition to these new superalloys because of its detrimental effect on superalloy hot corrosion resistance and because it is not necessary for the purposes of this invention. Consequently these new alloys preferably contain no more than the incidental amounts of columbium introduced with tantalum as a minor impurity.

We have discovered that these additive elements are effective for this purpose in relatively small amounts in vaccum-melting operations and that within certain limits they can be used singly or together in any desired combination to secure consistently the new results and advantages of this invention.

In making this invention, we have established that the beneficial effects of carbon on creep strength are not forfeited to any appreciable degree as a result of isolating carbon in the form of monocarbide throughout the grains and in the grain boundaries of the superalloy. Further, we have established that such distribution and isolation of carbon in that form does not preclude good weldability, metallurgical stability and tensile ductility, all of which are normally adversely affected by carbon in proportions preferred in accordance with this invention.

We have further discovered that the new results and advantages of this invention can consistently be obtained only through the use of at least 0.45% tantalum, and that while selection of other elements of the monocarbide MC-carbide former group is a matter of choice for the operator as to kind, the total amounts used are critically important. Thus the balance between the carbon content of the alloy and the total of those elements expressed as the ratio of the sum of the atomic percent of those elements to the atomic percent of carbon must be within the range of 0.4 to 0.8. In the superalloy of our present preference that ratio is 0.62.

Another finding of ours is that the stress-rupture properties of these new superalloys can be substantially increased by special and critical heat treatment. Moreover this can be accomplished with out penalizing the superior weldability or the hot corrosion resistance of these new superalloys. Thus by solutioning substantially the M23C6 eutectic carbide phase of a casting of one of these new superalloys and thereafter aging the body to precipitate the carbide phase in fine particulate form distributed substantially uniformly throughout the casting microstructure, the stress-rupture strength and the tensile strength are critically increased as the benefits of the carbide constituent of the superalloy are maximized and the usual detriments of carbon are minimized or totally eliminated.

Briefly described in its composition of matter aspect, the present invention is a cobalt-base superalloy having an unique combination of properties at high temperature and consequent special utility in the production of industrial gas turbine hot gas path components, consisting essentially of 0.3–0.6% carbon, 27–35% chromium, 9–16% nickel, 6–9% tungsten, up to 3% hafnium, 0.45–2.0% tantalum, up to 0.7% zirconium, up to 0.5% titanium, up to 1.0% manganese and silicon, up to 0.05% boron, up to 2.0% iron, remainder essentially cobalt. An additional important requirement is that the monocarbide MC-carbide former elements be so selected as to satisfy the relationship stated above and represented by the following equation:

$$\frac{\text{Atomic Percent (Ta + Hf + Zr + Ti + Cb)}}{\text{Atomic Percent C}} = 0.4 \text{ to } 0.8$$

and $$\frac{\text{Atomic Percent Ta}}{\text{Atomic Percent C}} = >0.1$$

Similarly described in its article-of-manufacture aspect, the present invention is a cast cobalt-base superalloy industrial gas turbine nozzle consisting of the new alloy set forth immediately above. Also, in this aspect the invention takes the form of transition pieces and shrouds, and of a fabricated cobalt-base superalloy gas turbine combustion chamber comprising a plurality of sheets of the said new alloy rolled and formed in predetermined shape and assembled and welded together. Still further in both cast and fabricated form these new bodies have an unique combination of properties attributable to special critical heat treatment. In particular, they have excellent hot corrosion resistance, stress-rupture strength at high temperature, metallurgical stability, tensile ductility and weldability.

The method aspect of the present invention, likewise described in broad general terms, comprises the steps of casting a superalloy of this invention and subjecting the resulting cast body to elevated temperatures and thereby substantially solutioning the eutectic carbide phase (M23C6), and thereafter subjecting the cast body to a substantially lower temperature well above room temperature to precipitate the carbide phase in fine particulate form distributed substantially uniformly throughout the microstructure of the cast body.

BRIEF DESCRIPTION OF THE DRAWINGS

In the drawings accompanying and forming a part of this specification.

DETAILED DESCRIPTION OF THE PREFERRED EMBODIMENTS

Figure 1:
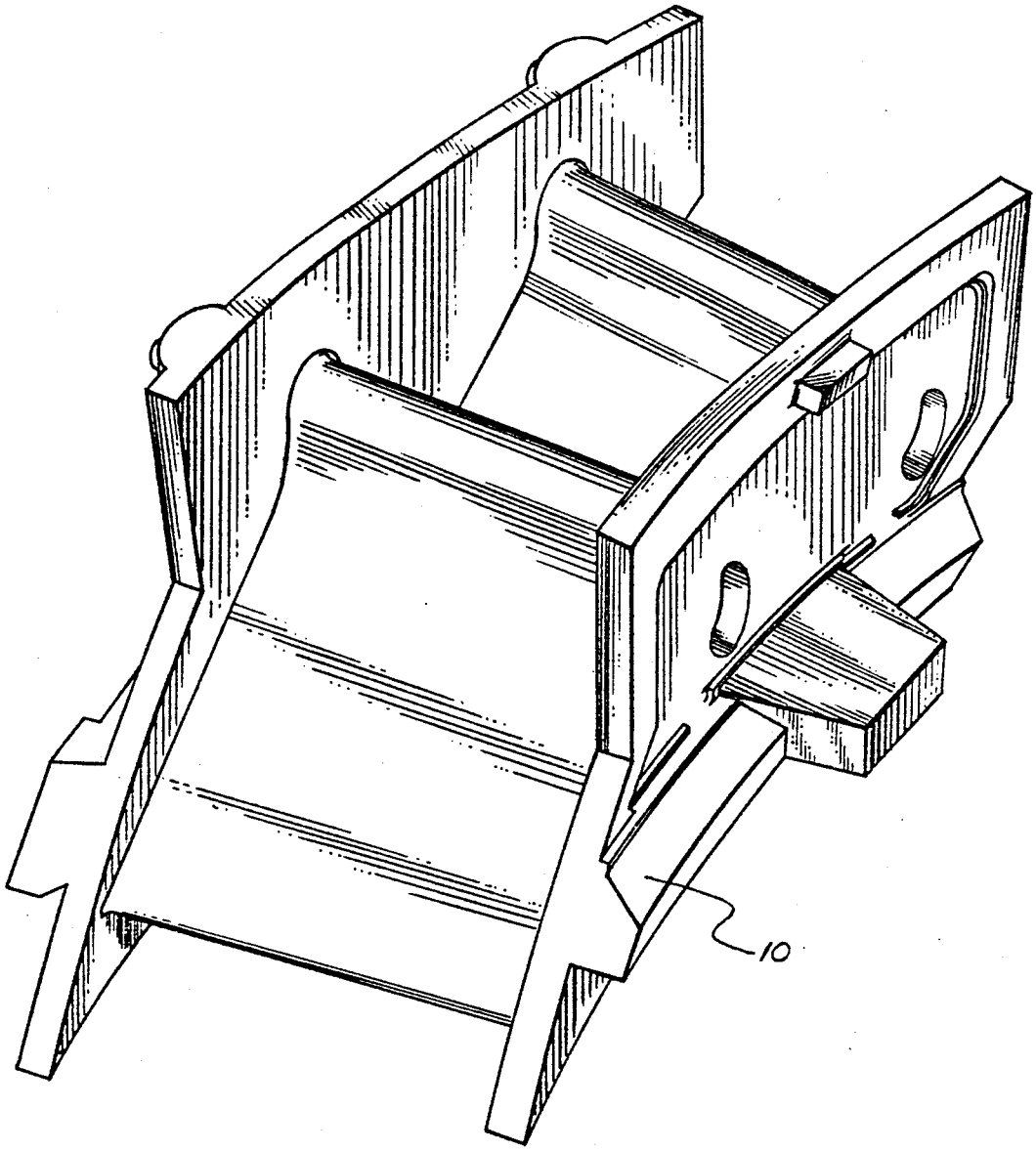
FIG. 1 is a view in perspective of an industrial gas turbine nozzle of this invention.

Because as indicated above and described in detail below particularly in reference to FIGS. 2 and 3 the composition of these new superalloys is critical in that small changes can result in major differences in desirable properties, the formulation of these alloys and the production of articles made thereof are carried out with special care. Thus in our best vacuum melting and casting practice these alloys are made by adding carefully controlled amounts of tantalum, and one or more of hafnium, titanium and Zirconium to a melt of the major constituents . The proportions of the MC-former constituents are carefully controlled in this operation as to both ranges of the major constituents and the maximum amounts of minor or impurity elements such as iron, manganese, silicon and boron so that the new advantages and results of this invention are consistently obtained.

A consequence of failure to exercise such control is the loss of one or more of the important advantages of this invention. The excellent weldability of these new alloys is forfeited, for example, when the amounts of monocarbide MC-carbide formers used are not in balance with the alloy carbon content as described above and set forth in the appended claims. Further in this regard the chromium content of these alloys is preferably targeted at 28–30% in recognition that departures in each direction can penalize alloy properties, specifically amounts less than about 27% result in loss of oxidation and high temperature hot corrosion resistance and amounts greater than about 35% result in loss of ductility without offsetting gain in either oxidation resistance or hot corrosion resistance.

Differences of major importance between the superalloys of this invention and the novel articles made thereof and the superalloys and products thereof of the prior art are graphically illustrated in FIGS. 2 and 3 which depict data gathered through experiments described below. Thus the greater stress rupture properties of an alloy of this invention in two different heat treatment conditions over an alloy of the prior art are evident from curves A, B, C of FIG. 2. Similarly the superior weldability of five alloys of this invention over two of those of the prior art are evident from Curves IV A-D and Curve BB and Curves AA and E, respectively, of FIG. 3. It may be noted in this connection the alloy of Curve BB is somewhat superior of the others of this invention in respect of weldability and is far superior to the prior art alloys of Curves AA and E.

The cast and fabricated bodies of this invention, being components of industrial gas turbines, are quite different from aircraft jet engine components especially in respect to size and mass. Because of this, they represent problems unlike those of the relatively lighter weight counterparts such as marked cracking tendency associated with welding operations. This has significant implication for cast as well as fabricated industrial gas turbine components as it would obviously be highly desirable to be able to weld repair industrial gas turbine nozzles to avoid the item and expense of replacement. Gaining this advantage without forfeiting any other desirable feature constitutes an important advance in the art. Likewise, the opportunity to build industrial gas turbine combustion chamber structures by welding preformed sheets or plates together which is enabled as a result of this invention, its alloys having excellent weldability, is an important new advance in the production of industrial gas turbines. In our practice of such welding operations as these we prefer to use the gas tungsten arc technique and equipment in general use in industry in the fabrication of both ferrous and nonferrous metal structures, including those of cobalt-base superalloys.

The first stage nozzle 10 of an industrial gas turbine shown in FIG. 1 is a casting of our preferred alloy composition produced by the injection molding and investment casting technique in general use in the art. Also, the shape and size and the design details of nozzle 10 essentially duplicate those features of the present standard first stage nozzle.

Figure 4:
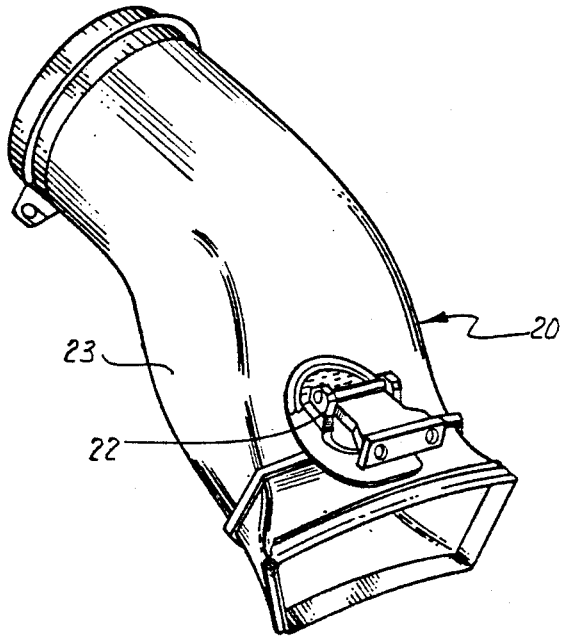
FIG. 4 is a view in perspective of an industrial gas turbine transition piece of this invention.

Transition piece 20 shown in FIG. 4 similarly resembles that which has long been in general use in industrial gas turbines differing importantly, however, in that it is constructed of parts of an alloy of this invention welded together to provide a strong crack-free assembly of integrally-bonded elements. Thus, bracket 22 is fitted in place on body 23 and welded securely thereto.

Those skilled in the art will gain a further and better understanding of this invention and its important new advantages and results from the following illustrative, but not limiting, detailed accounts of actual experiments.

EXAMPLE I

Investment castings for test purposes were made of a commercial cobalt-base alloy of the following analysis:

| | |
|---|---|
| carbon | 0.25 |
| chromium | 29.0 |
| nickel | 10.0 |
| tungsten | 7.0 |
| manganese | 0.7 |
| silicon | 0.7 |
| phosphorus | 0.02 |
| sulphur | 0.02 |
| iron | 1.0 |
| boron | 0.015 |
| cobalt | remainder |

This superalloy is disclosed and claimed in U.S. Pat. No. 3,383,205 assigned to the assignee hereof and has long been in general use in the production of industrial gas turbine hot stage components, particularly cast non-rotating parts such as first stage nozzles.

The cast test specimens were subjected to the heat treatment in general use in the art, specifically four hours at 2100° F. and four hours at 1800° F. The specimens were then subjected to standard tensile, stress-rupture and Varestraint weldability tests, the tensile and stress-rupture data being set out in Table I and the Varestraint data being illustrated. in FIG. 3. Curve A of FIG. 2 illustrates the Larson-Miller data while Curve AA of FIG. 3 represents the Varestraint data obtained by this experiment.

EXAMPLE II

A cobalt-base superalloy of this invention was tested in duplication of the test conditions and procedures of Example I, the superalloy having the following analysis.

| | |
|---|---|
| carbon | 0.357 |
| chromium | 28.56 |
| nickel | 10.88 |
| tungsten | 7.33 |
| tantalum | 0.53 |
| hafnium | 1.00 |
| zirconium | 0.496 |
| titanium | 0.184 |
| iron | 0.270 |
| silicon | 0.024 |
| sulphur | 0.004 |
| phosphorus | 0.005 |
| manganese | 0.005 |

The resulting test data are set forth in Tables 1 and 2 for ready comparison with those of Example I and those detailed below. Curve B of FIG. 2 illustrates the Larson-Miller data and Curve BB of FIG. 3 represents the varestraint data. Further, this superalloy was found on the performance of standard tests to have hot corrosion resistance superior to the cobalt-base alloy of Example I.

EXAMPLE III

Specimens prepared in repetition of the experiment of Example II were subjected to heat treatment of this invention consisting of heating to 2250° F. for 4 hours, air cooling to about room temperature, then heating to 1475° F. for 8 hours, and finally air cooling to room temperature. The stress rupture properties as measured in tests of the resulting heat-treated specimens are representative of Curve C of FIG. 2 and set out in Table 1 below.

Stress-rupture tests were run under the same conditions of temperature and stress on Example II heat treated specimens with the results stated in Table 1.

Additional tests were performed to compare weldability of these heat-treated specimens with those of Example II by the so called "patch test" technique involving highly restrained weldments such as would most likely be encountered in the weldment repair of industrial gas turbine nozzles. The Example II specimens exhibited rather substantial heat affected zone cracking, whereas in the specimens of the present Example such heat affected zone cracking was essentially nonexistent.

EXAMPLE IV

The experimental tests of Example I were conducted on four additional superalloys of this invention of the following compositions:

| | Alloy IV A 481 | Alloy IV B 482 | Alloy IV C 483 | Alloy IV D 485 |
|---|---|---|---|---|
| Carbon | 0.25 | 0.25 | 0.35 | 0.35 |
| Manganese | 0.70 | 0.70 | 0.70 | 0.70 |
| Silicon | 0.75 | 0.75 | 0.75 | 0.75 |
| Phosphorus | 0.04 | 0.04 | 0.04 | 0.04 |
| Sulphur | 0.04 | 0.04 | 0.04 | 0.04 |
| Chromium | 28.0 | 28.0 | 29.0 | 29.0 |
| Nickel | 10.0 | 10.0 | 10.0 | 10.0 |
| Tungsten | 7.0 | 7.0 | 7.0 | 5.0 |
| Iron | 0.5 | 0.5 | 0.5 | 0.5 |
| Zirconium | — | — | — | — |
| Hafnium | — | — | — | — |
| Titanium | — | — | — | — |
| Columbium | 0.5 | 1.0 | 1.0 | 1.25 |
| Tantalum | 0.5 | 0.5 | 0.5 | — |
| Boron | — | — | — | 0.01 |
| Cobalt | REM | REM | REM | REM |

Again, the test data developed in measuring the properties of these alloys as described above are stated in Tables 1 and 2.

EXAMPLE V

Another superalloy of the prior art of the cobalt-base type (U.S. Pat. No. 4,437,913) was prepared in specimen form and tested as described in Example I with the results stated in Tables 1 and 2 and shown as Curve E of FIG. 3 this particular alloy (Alloy E) being of the following composition;

| | |
|---|---|
| carbon | 0.35 |
| manganese | 0.70 |
| silicon | 0.75 |
| phosphorus | 0.04 |
| sulphur | 0.04 |
| chromium | 29.0 |
| nikel | 10.0 |

-continued

| | |
|---|---|
| tungsten | 7.0 |
| iron | 0.5 |
| zirconium | 0.20 |
| hafnium | — |
| titanium | 0.15 |
| columbium | 0.25 |
| tantalum | — |
| boron | 0.01 |
| cobalt | REM |

In regard to the tests carried out in the course of this experimental work to measure the properties of these various alloy compositions, as indicated above, standard test procedures were followed in every instance and the same procedures were applied for each respective alloy in the several tests so that comparisons could be made directly and reliable conclusions could be drawn from the resulting data. ASTM procedures were used, therefore, in the tensile and stress rupture tests and in the case of the Varestraint test the procedure followed was that described in Welding Research Council Bulletin 280 in the article entitled "The Varestraint Test", C. D. Ludlum, et al, August 1982.

TABLE 1

| | Tensile Tests | | | | Stress Rupture Tests | | | | |
|---|---|---|---|---|---|---|---|---|---|
| SUPERALLOY | Temp (°F.) | ULT Tensile Strength (Kpsi) | Elong. Percent | RA Percent | Temp (°F.) | Stress (Kpsi) | Life (Hrs) | Elong. Percent | RA Percent |
| EXAMPLE I | 70 | 86.0 (Ave) | 7.0 (Ave) | 9.5 (Ave) | | | (See FIG. 2) | | |
| EXAMPLE II | 70 | 102.0–107.8 | 7.0–5.5 | 7.9–5.6 | 1400 | 30 | 106.1 | 27.7 | 35.0 |
| | | | | | 1400 | 25 | 302.1 | 26.0 | 38.0 |
| | | | | | 1500 | 20 | 854.1 | 24.6 | 26.0 |
| | | | | | 1600 | 16 | 684.0 | 23.4 | 32.0 |
| | | | | | 1700 | 12.5 | 624.6 | 17.3 | 23.0 |
| | | | | | 1800 | 10 | 288.7 | 19.3 | 15.0 |
| EXAMPLE III | | Invention Heat Treatment | | | 1400 | 30 | 177.0 | 24.3 | 34.0 |
| | | | | | 1400 | 25 | 3518.0 | 16.7 | 51.8 |
| | | | | | 1500 | 20 | 3856+ | Did not fail | |
| | | | | | 1600 | 16 | 3014+ | Did not fail | |
| | | | | | 1700 | 12.5 | 2786.6 | 14.0 | 25.5 |
| | | | | | 1800 | 10 | 798.7 | 14.3 | 17.0 |
| EXAMPLE IV-A | 70 | 97.0–77.9 | 10.0–8.0 | 12.3–15.3 | 1700 | 11 | 153.4 | 34.2 | |
| | | | | | 1800 | 7.4 | 233.9 | 22.6 | |
| EXAMPLE IV-B | 70 | 73.6–83.1 | | | 1700 | 11 | 212.7 | 26.4 | |
| EXAMPLE IV-C | 70 | 92.8–85.1 | 4.0–4.0 | 3.2–7.2 | 1700 | 11 | 299.2 | 18.4 | 38 |
| | | | | | 1800 | 8 | 392.4 | 20.8 | 34 |
| EXAMPLE IV-D | 70 | 90.5–85.5 | 4.0–4.0 | 4.8–10.0 | 1700 | 11 | 526.9 | 25.8 | 39 |
| EXAMPLE V-E | 70 | 115.1–116.2 | 7.0–7.0 | 9.3–7.8 | 1700 | 11 | 986.4 | | |
| | | | | | 1750 | 11 | 166.0 | 21.0 | 47 |

TABLE 2

| | VARESTRAINT TESTS | | | | |
|---|---|---|---|---|---|
| SUPERALLOY | Augmented Strain (%) | Number of Cracks | Ave. Crack Length (mils) | Total Crack Length (mils) | Longest Crack Length (mils) |
| EXAMPLE II | 0.50 | 0 | 0 | 0 | 0 |
| | 1.04 | 0 | 0 | 0 | 0 |
| | 1.56 | 0 | 0 | 0 | 0 |
| | 2.50 | 1 | 14 | 14 | 14 |
| EXAMPLE IV-A | 0.50 | 0 | 0 | 0 | 0 |
| | 1.04 | 3 | 5 | 11.2 | 56.0 |
| | 1.56 | 5 | 21.40 | 107.0 | 36.0 |
| | 2.50 | 8 | 24.38 | 195 | 64.0 |
| EXAMPLE IV-B | 0.5 | 0 | 0 | 0 | 0 |
| | 1.04 | 1 | 9 | 9 | 9 |
| | 1.56 | 3 | 19.33 | 58 | 32 |
| | 2.50 | 6 | 15.17 | 91 | 24 |
| EXAMPLE IV-C | 0.50 | 1 | 36 | 36 | 36 |
| | 1.04 | 5 | 15.80 | 79.0 | 36 |
| | 1.56 | 4 | 23.25 | 93 | 37 |
| | 2.50 | 9 | 20.87 | 188 | 37 |
| EXAMPLE IV-D | 0.50 | 0 | 0 | 0 | 0 |
| | 1.04 | 3.0 | 14.33 | 43.0 | 23.0 |
| | 1.56 | 6.0 | 17.67 | 106.0 | 36.0 |
| | 2.50 | 8.0 | 16.75 | 134 | 32.0 |
| EXAMPLE V-E | 0.50 | 0 | 0 | 0 | 0 |
| | 1.04 | 7 | 18.71 | 131 | 30.0 |
| | 1.56 | 5 | 27.40 | 137 | 36.0 |
| | 2.50 | 15 | 24.27 | 364 | 50.0 |

As evident from Table 1, the superalloys of this invention (Examples II and Examples IVA-D) have ultimate tensile strengths equal to or better than the commercial superalloy of Example I and have stress-rupture strength substantially greater than that commercial superalloy. Further, it is apparent from Table 1 that these new superalloys have good room temperature tensile elongation characteristics and as Table 2 shows and FIG. 3 graphically illustrates, the weldability of the superalloys of this invention is superior to commercial superalloys AA and E and even spectacularly so in the case of the superalloy BB of Example II which, as indicated above, is our present preferred embodiment of the invention. It will also be noted that as indicated in parentheses on that chart, the superalloys of this invention set forth in Examples II and IV have carbide former-carbon atomic percent ratios within the above prescribed critical range of 0.4 to 0.8, while the prior art alloys of Examples I and V do not come close to meeting that important requirement.

Figure 2:
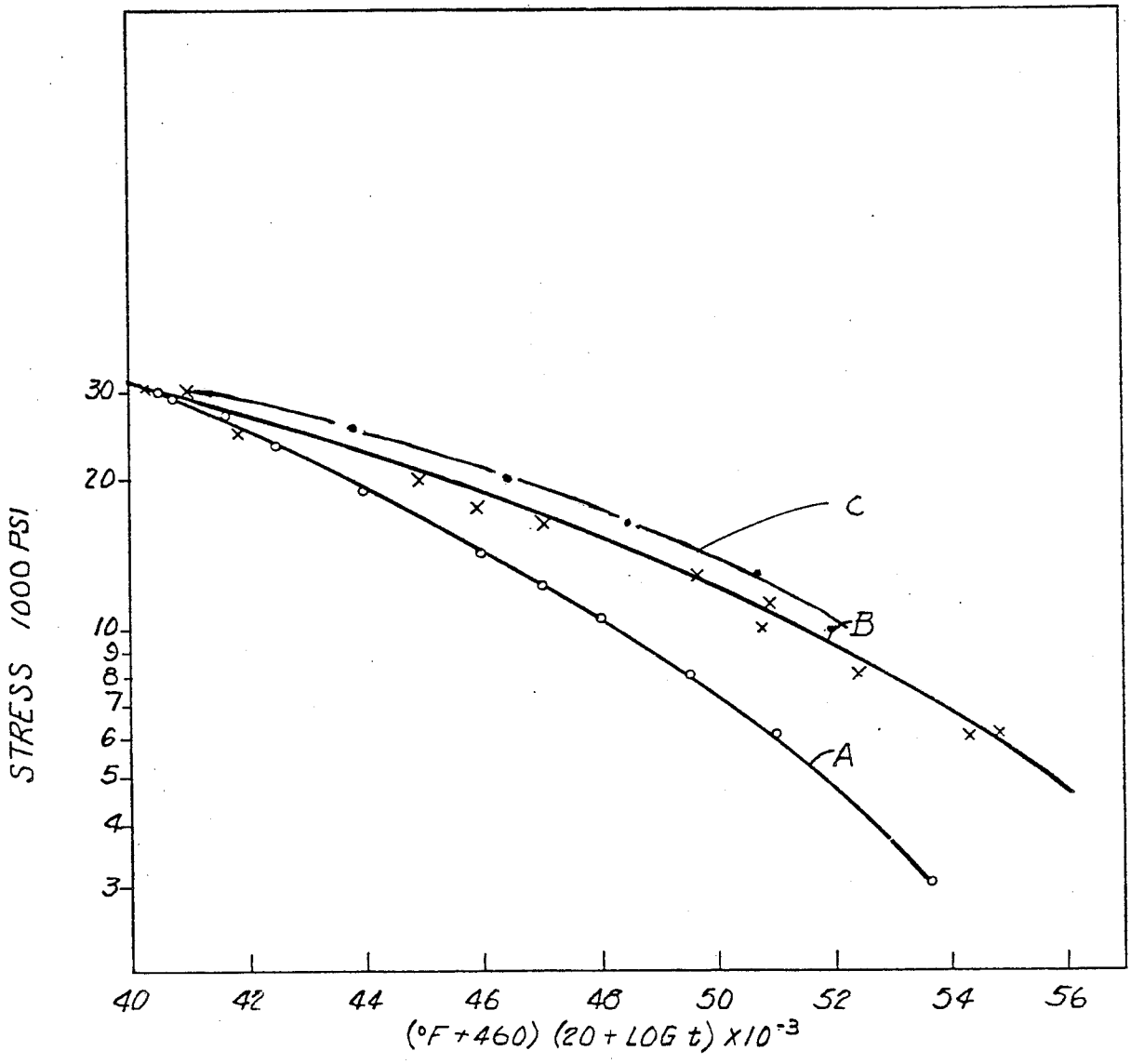
FIG. 2 is a Larson-Miller plot of the stress rupture properties of an alloy of U.S. Pat. No. 3,383,205 and one of this invention subjected to heat treatment in one instance the same as that of said-205 Patent and in second case as carried out in accordance with this invention.
Figure 3:
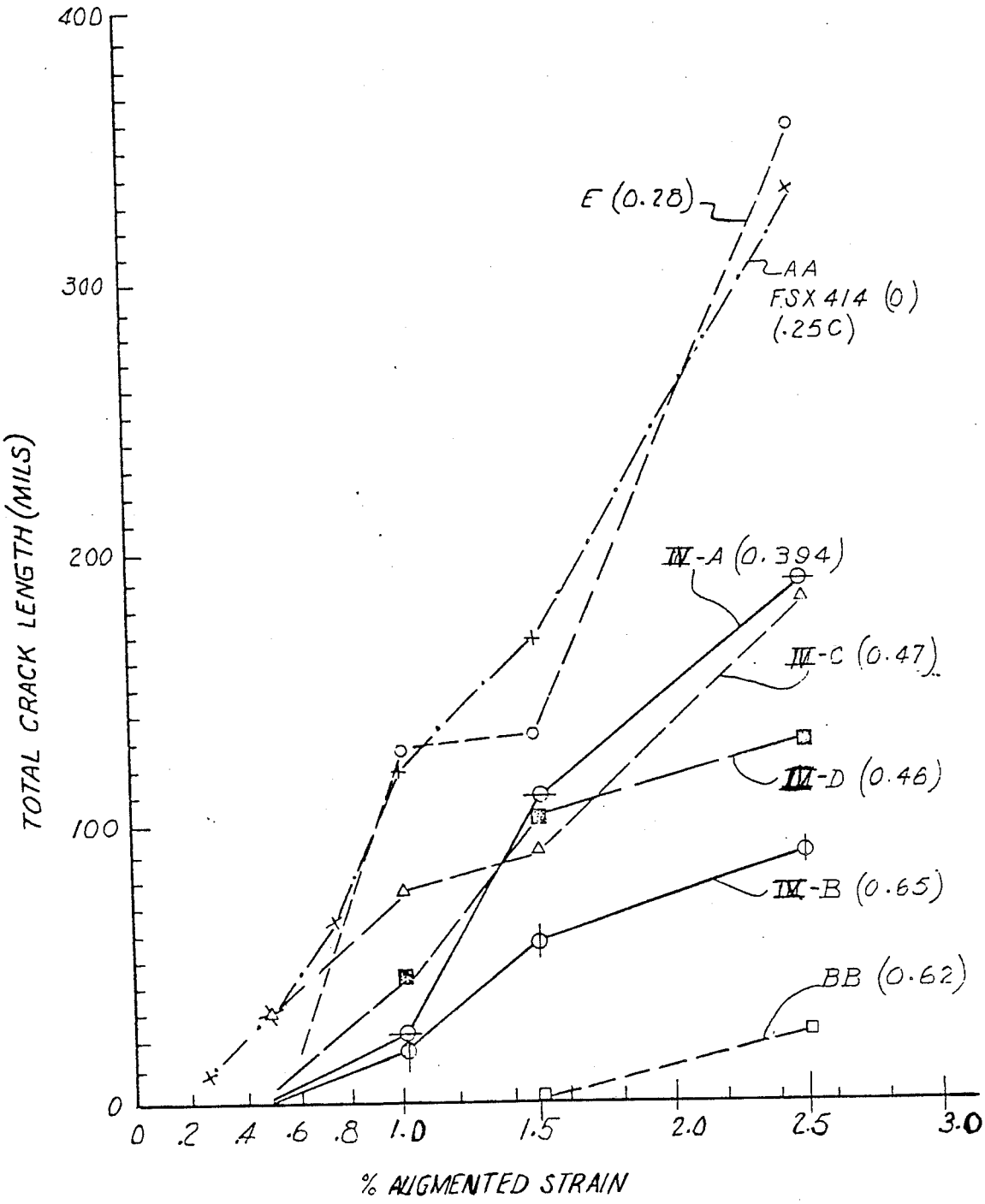
FIG. 3 is a chart bearing curves illustrating Varestraint welding test results on five alloys of this invention and two prior art alloys including that of U.S. Pat. No. 3,383,205, total crack length in mils being plotted against percent augmented strain.

As indicated above and evidenced by the experimental data set out in Tables 1 and 2 and graphically illustrated in FIGS. 2 and 3 the present novel superalloys and the heat-treatment of this invention each afford important new properties advantages. Further, these two inventions in combination afford still greater advantages in terms of stress-rupture strength. Thus the effect of the novel heat-treatment results in significantly higher stress-rupture strength of one of the present new superalloys as shown by Curve B (standard heat-treatment) and Curve C (new heat-treatment) and makes that new superalloy even more superior to the Curve A superalloy of the prior art presently in general use. Analysis of these data curves indicates that in the stress range 10–20 ksi this advantage translates into approximately a 40° F. temperature improvement for the superalloy of this invention of Curve B and a 110°–160° F. temperature improvement over the prior art alloy of Curve A. Consequently for given stress and time to failure the new alloy of this invention of Curve B with the new heat treatment can withstand 40° F. more than with the standard heat treatment and 110°–160° F. more than the prior art alloy of Curve A. On the basis of stress to a given time to failure at a given temperature such as 1000 hours at 1800° F. these data indicate an improvement of about 1.5 ksi for the new alloy of Curve B with the new heat treatment as opposed to the standard heat treatment and about 6 ksi over the Curve A superalloy of the prior art subjected to the standard heat-treatment.

Further, the data represented by Curve C suggest a 1000 hour stress-rupture strength at 1800° F. of about 10.5 ksi versus 8.1ksi for the best of the alloys set out in the Table of U.S. Pat. No. 4,437,913. In regard to time to failure for the alloy of Curve B in the two different heat-treatment conditions under identical test conditions Table 1 herein indicates substantial improvements with the new heat-treatment with nearly a factor of 10 being achieved in the best case.

It is especially noteworthy that this new heat-treatment not only improves stress-rupture strength but also improves weldability as described in Example III.

Figure 5:
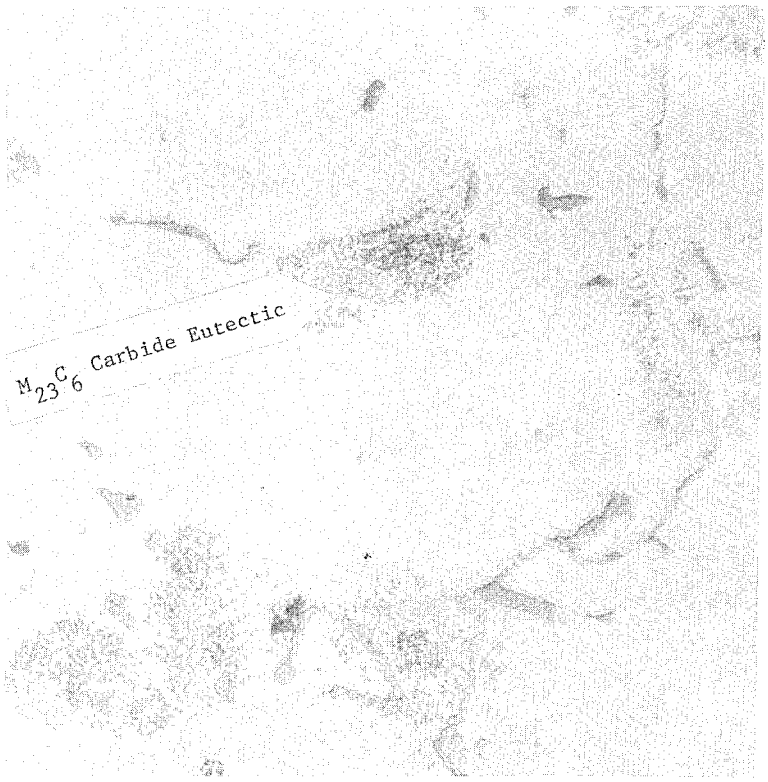
FIG. 5 is a photomicrograph of the microstructure of a cast superalloy body of this invention heat treated in accordance with the prior art (2100° F. for 4 hours and 1800° F. for 4 hours)
Figure 6:
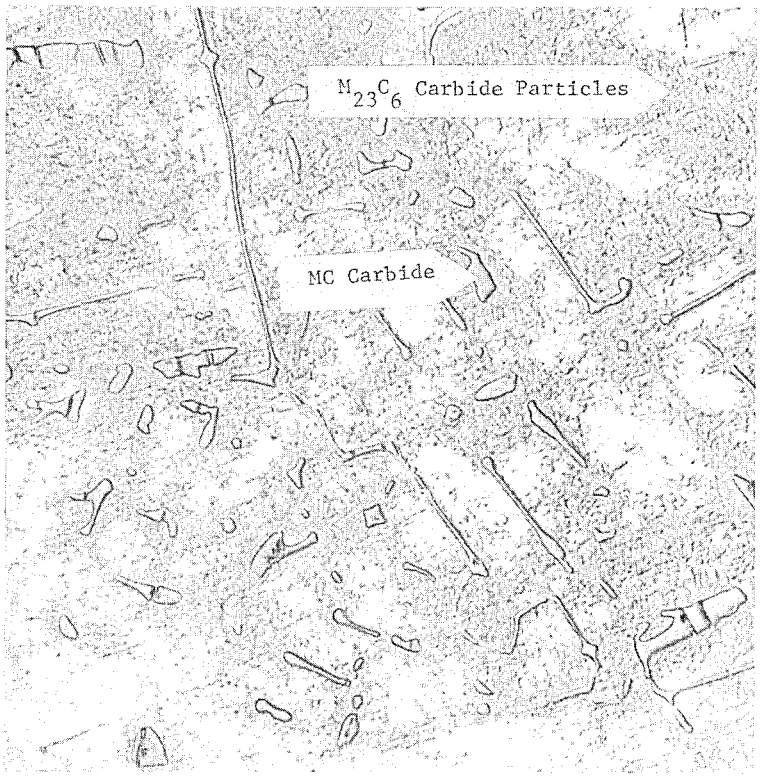
FIG. 6 is a photomicrograph of microstructure of the body of FIG. 5 heat treated in accordance with this invention (2250° F. for 4 hours and 1475° F. for 8 hours).

Microstructural characteristics provide a clue as to the reasons for the outstanding mechanical properties of the present novel superalloys heat treated in accordance with this invention. As indicated in FIG. 5, eutectic colonies of the M23C6 carbide phase, which is the main second phase strengthening precipitate in the superalloy, are distributed throughout the cast structure of the alloy given the standard heat treatment. With the new heat treatment of this invention, the eutectic colonies have been largely dissolved, and the M23C6 carbide reprecipitated in fine particulate form throughout the structure (FIG. 6). This fine precipitate distribution constitutes a more optimum morpholgy for high temperature strength than does the eutectic colony morphology. Furthermore, dissoloution of the eutectic colony structure produces a more ductile alloy matrix in the solution treated condition, which is believed to be the reason for the improved weldability obtained with this heat treatment.

In the specification and the appended claims whenever percentage or proportion is stated, reference is to the weight bases unless otherwise expressly noted.

What is claimed is:

1. The method of producing a cobalt-base superalloy body having an unique combination of superior stress rupture strength and weldability properties and consequent special utility in application to industrial gas turbine hot gas path components which comprises the steps of casting in desired size and shape a superalloy consisting essentially of, by 0.3 to 0.6 percent carbon
27 to 35 percent chromium
9 to 16 percent nickel
6 to 9 percent tungsten
0.45 to 2.0 percent tantalum
up to 0.5 percent titanium
up to 3.0 percent hafnium
up to 0.7 percent zirconium
up to 1.0 percent manganese
up to 1.0 percent silicon
up to 0.05 percent boron
up to 2.0 percent iron
balance cobalt, the carbon, tantalum, hafnium, titanium and zirconium being so selected as to satisfy the following equation:

$$\frac{\text{Atomic Percent (Ta + HF + Ti + Zr + Cb)}}{\text{Atomic Percent C}} = 0.4 \text{ to } 0.8$$

and $$\frac{\text{Atomic Percent Ta}}{\text{Atomic Percent C}} = >0.1$$

subjecting the resulting cast body containing M23C6 eutectic phase to elevated temperature and thereby solutioning substantially all M23C6 eutectic phase, thereafter cooling the said body and thereby precipitating substantially all the M23C6 carbide phase in the form of fine particulate distributed substantially uniformly throughout the body microstructure.

2. The method of claim 1 in which the cast body is subjected to temperature about 2250° F. until solutioning of the eutectic phase is substantially complete, thereafter subjecting the body to temperature of approximately 1475° F. until precipitation of the M23C6 particulate phase is substantially complete and finally cooling the body to room temperature.

3. The method of claim 2 in which the body is air cooled from solutioning temperature to about room temperature and thereafter is heated to precipitation temperature and upon completion of the precipitation of the particulate carbide phase the body is finally air cooled to room temperature.

4. The method of claim 3 in which the solutioning temperature is 2250° F. and the body is maintained at that temperature for approximately 4 hours, and in which the precipitation temperature is about 1475° F. and the body is maintained at that temperature for about 8 hours.

5. The method of claim 4 in which the superalloy has the following analysis:

Carbon 0.357%
Chromium 28.56
Nickel 10.88
Tungsten 7.33
Tantalum 0.53

Hafnium 1.00
Zirconium 0.496
Titanium 0.184
Iron 0.270
Silicon 0.024
Sulfur 0.004
Phosphorus 0.005
Manganese 0.005
Cobalt Remainder.

6. A cobalt base superalloy consisting essentially of
Carbon 0.357%
Chromium 28.56
Nickel 10.88
Tungsten 7.33
Tantalum 0.53
Hafnium 1.00
Zirconium 0.496
Titanium 0.184
Iron 0.270
Silicon 0.024
Sulfur 0.0004
Phosphorus 0.005
Manganese 0.005
Cobalt Remainder
said superalloy having microstructure characterized by substantially all M23C6 eutectic carbide phase being in the form of fine particulate distributed substantially uniformly throughout the superalloy microstructure.

7. An industrial gas turbine nozzle made of cobalt-base superalloy having excellent hot corrosion resistance, and stress-rupture strength at high temperature, metallurigical stability, tensile ductility and weldability, said superalloy consisting essentially of
0.357 percent carbon
28.56 percent carbon
10.88 percent nickel
7.33 percent tungsten
0.53 percent tantalum
0.184 percent titanium
1.00 percent hafnium
0.496 percent zirconium
0.005 percent manganese
0.024 percent silicon
0.005 percent phosphorus
0.270 percent iron
Remainder cobalt
said nozzle having microstructure characterized by substantially all M23C6 eutectic carbide phase being in the form of fine particulate distributed substantially uniformly throughout the superalloy nozzle microstructure.

8. A fabricated industrial gas turbine transition piece made of cobalt-base superalloy comprising a plurality of sheets rolled and formed in predetermined shape and assembled and welded together to define the piece, said superalloy consisting essentially of
0.357 percent carbon
28.56 percent chromium
10.88 percent nickel
7.33 percent tungsten
0.53 percent tantalum
0.184 percent titanium
1.00 percent hafnium
0.496 percent zirconium
0.005 percent manganese
0.024 percent silicon
0.005 percent phosphorous
0.270 percent iron
Remainder Cobalt
said transition piece having microstructure characterized by substantially all M23C6 eutectic carbide phase being in the form of fine particulate distributed substantially uniformly throughout the superalloy transition piece microstructure.

* * * * *